US005181720A

United States Patent [19]

Stites, III et al.

[11] Patent Number: 5,181,720

[45] Date of Patent: Jan. 26, 1993

[54] GOLF CLUB CONSTRUCTION

[75] Inventors: John T. Stites, III; Jerome M. Austry, both of Fort Worth, Tex.

[73] Assignee: Head Sports, Inc., Fort Worth, Tex.

[21] Appl. No.: 807,403

[22] Filed: Dec. 12, 1991

Related U.S. Application Data

[63] Continuation-in-part of Ser. No. 692,170, Apr. 26, 1991, abandoned, which is a continuation-in-part of Ser. No. 525,879, May 17, 1990, abandoned.

[51] Int. Cl.[5] ..... A63B 53/02

[52] U.S. Cl. ..... 273/80.2; 273/80.8

[58] Field of Search ..... 273/80, 80.2, 80.3, 273/80.5, 80.6, 80.8, 169

[56] References Cited

U.S. PATENT DOCUMENTS

| | | | |
|---|---|---|---|
| 1,464,550 | 8/1923 | Thorpe | 273/80.6 |
| 1,540,559 | 6/1925 | Murphy | 273/80.3 |
| 1,589,707 | 6/1926 | Kraeuter | 273/80.5 |
| 1,601,770 | 10/1926 | Reach et al. | 273/80.6 |
| 1,638,916 | 8/1927 | Butchart | 273/169 |
| 1,643,754 | 9/1927 | Sleith | 273/80.3 |
| 1,690,266 | 11/1928 | Barrett | 273/80.8 |
| 1,829,900 | 11/1931 | Johnson | 273/80.8 X |
| 1,958,032 | 5/1934 | Cocke | 273/80.8 |
| 2,121,387 | 6/1938 | Houser | 273/80.3 |
| 2,171,483 | 8/1939 | Simonton | 273/80.5 |
| 2,299,735 | 10/1942 | Birkhofer | 273/80.8 |
| 3,410,558 | 11/1968 | Reuter, Jr. | 273/80.2 |
| 3,909,005 | 9/1975 | Piszel | 273/80.5 X |
| 4,063,737 | 12/1977 | Tom et al. | 273/80.8 X |

OTHER PUBLICATIONS

Wilson Golf History–Catalogs (1981), esp. under heading "1956".

1938 Professional, p. 4, Wilson Catalog.

1957 Professional, p. 8, Wilson Catalog.

"What a Difference a Year Makes", Callaway Golf (Jun. 8, 1990).

1959 Professional, p. 1, Wilson Catalog.

"Metalwood Distance", Golf World (Aug. 24, 1990).

"We Do", Callaway Golf (Mar. 1989).

*Primary Examiner*—William H. Grieb

*Attorney, Agent, or Firm*—Finnegan, Henderson, Farabow, Garrett & Dunner

[57] ABSTRACT

A golf club includes a club shaft and a club head. The club shaft has a grip end and an opposed hollow end. The club head includes a body, a male pin and a female hosel disposed about the pin, the pin and the hosel together defining an annulus therebetween configured and dimensioned to receive therein the hollow shaft end. Adhesive is disposed both in a first bond line intermediate the inner surface of the hollow shaft end and the outer surface of the pin, and in a second bond line intermediate the outer surface of the hollow shaft end and the inner surface of the hosel.

40 Claims, 2 Drawing Sheets

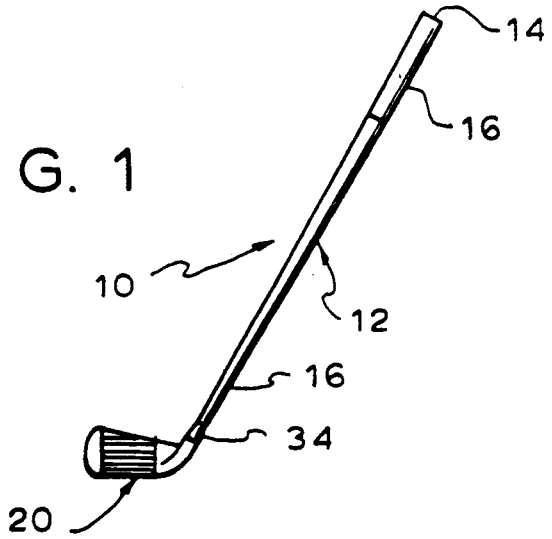
FIG. 1
FIG. 3
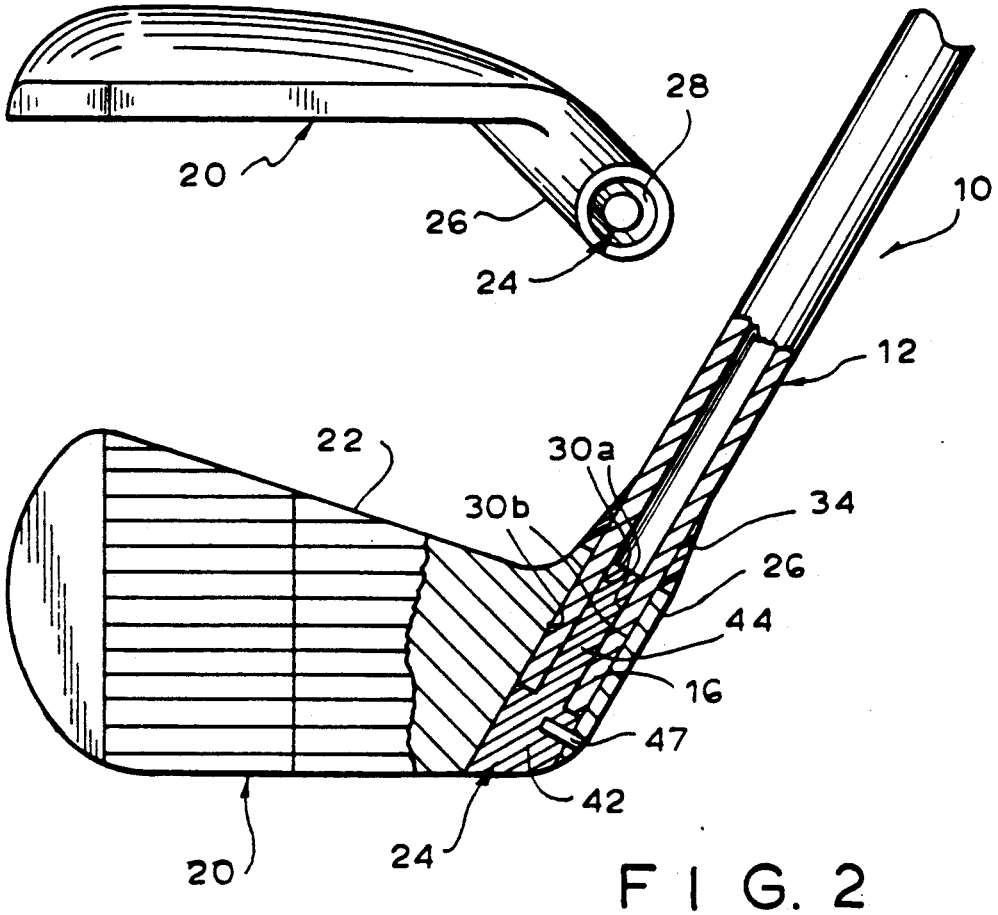
FIG. 2

GOLF CLUB CONSTRUCTION

CROSS-REFERENCE TO RELATED APPLICATION

This is a continuation-in-part of application Ser. No. 07/692,170 filed on Apr. 26, 1991, now abandoned, which is a continuation-in-part of application Ser. No. 07/525,879, filed May 17, 1990, now abandoned.

BACKGROUND OF THE INVENTION

The present invention relates to a golf club, and more particularly to a golf club having novel means connecting the head and the shaft together.

There are two conventional means of forming a golf club by joining the club shaft, with its grip end and an opposed hollow end, to a club head, including a body and a hosel. In one alternative, the head defines a female hosel into which the male end of the shaft (whether hollow or solid) is inserted, with the male and female elements being secured by a glue or bond line between the outside diameter of the shaft and the inside diameter of the female hosel. Alternatively, the head defines a male hosel over which the hollow female end of the shaft is inserted, with the male and female elements being secured together by a glue or bond line between the inside diameter of the shaft and the outside diameter of the hosel. In both instances, however, a glue or bond line of at least 1¼ in. is required in order to provide the minimum surface area contact between the shaft and the head necessary to achieve the desired level of bonding therebetween. In particular instances, in addition to the bond line provided by the adhesive (typically epoxy), the bonding of the shaft and head is in some cases increased by press fitting of the shaft and hosel together, and/or even by the use of rivet pins extending through the hosel and shaft. In addition to the obvious necessity of securing the head to the shaft in order to form the golf club, the secure attachment between the shaft and head is necessary to provide an effective transmission of impact.

The ability of the shaft to flex adjacent the head is very beneficial to both the feel and performance of the club. While the shaft of the golf club (especially if hollow) is capable of a limited amount of flexing so as to impart a desirable whipping action to the golf ball upon impact, the design and construction of the hosel typically does not admit of such flexing of the hosel. Accordingly, where the shaft end and hosel overlap, the shaft within the female hosel or about the male hosel is precluded from the desired flexing. The greater the overlap of the hosel and shaft end, the greater the restriction on flexing of the shaft adjacent the head, and thus the poorer the performance of the club. Accordingly, the length of the overlap is a compromise between the desire to increase the bond line length (along the axis of the shaft) to provide a secure attachment of the shaft and head together, and the desire to decrease the bond line length in order to minimize the degradation of the performance of the club. According to either of the conventional constructions described above (that is, either the female hosel or the male hosel), approximately the same minimum bond line length of about 1.25 inches is required so that there is necessarily about the same minimum level overlap and hence the same deterioration of club performance.

Conventionally golf club shafts are made of either steel or graphite. The graphite shafts are normally lighter (i.e., less dense) than steel shafts Accordingly, a graphite shaft requires a golf club head that is heavier than that required for a steel shaft in order to maintain the same swing weight for the two clubs. Swing weight is a moment factor that is increased or decreased by increasing or decreasing the static weight of the head. Thus, it is impossible to use the same head with both steel and graphite shafts without affecting the swing weight of the complete golf club. Additionally, particular golfers will prefer slightly higher or lower swing weights for their clubs. Thus, it would be highly desirable to enable the swing weight of the club to be varied easily in order to meets the desires of particular golfers or the particular shaft with which a head is to be used, without a need for changing the head or or using a special head.

The normal manufacturing process for a golf club head rarely yields production volumes having a uniformity better than +/− 3 grams. A +/− 3 gram range yields finished clubs that are inside a range of approximately 4 swing weight units. An ideal assembled tolerance would be +/− 0.5 swing weight units. In order to compensate for these variations in the normal manufacturing process or to personalize the club for a particular user, the head weight is conventionally varied by using more or less adhesive or glue at the hosel/shaft overlap to increase or diminish the weight of the head and thereby bring the club into the desired swing weight range. This method of adjustment is not recommended, however, as too great a reduction in the amount of the adhesive used to connect the hosel and the shaft may diminish the security with which the head and shaft are secured together. In any case, the amount of adjustment possible by this method is limited by the typically low density of the adhesive. Another method of adjusting the swing weight of the club is to insert high density lead slugs within the shaft hollow end when the clubs are too light. These slugs must be soldered or otherwise securely attached to the shaft in order to preclude them from separating from the shaft during use of the golf club, thereby increasing the cost of materials and labor.

Accordingly, it is an object of the present invention to provide a golf club construction in which a bond line of reduced length provides an attachment of equivalent security between the shaft and the head.

Another object is to provide such a golf club construction which enables a minimum overlap of the shaft and head so as to improve golf club performance without impairing the security of the attachment of the head and the shaft.

A further object is to provide such a golf club construction in which the swing weight can be varied without changing the club head in order to accommodate different shaft types.

It is also an object of the present invention to provide such a golf club construction which facilitates adaptation of the golf club swing weight to the taste of a particular user.

It is a further object to provide such a golf club construction which facilitates compensations for manufacturing variations in head weight.

SUMMARY OF THE INVENTION

It has now been found that the above and related objects of the present invention are obtained in a golf club comprising a club shaft, a club head, and adhesive means. The club shaft has a grip end and an opposed hollow end. The club head has a body, a male pin and a female hosel disposed about the pin. The pin and the hosel together define an annulus therebetween configured and dimensioned to receive therein the hollow shaft end. Adhesive means is disposed both in a first bond line intermediate the inner surface of the hollow shaft end and the outer surface of the pin and in a second bond line intermediate the outer surface of the hollow shaft end and the inner surface of the hosel.

In a preferred embodiment the first and second bond lines are of about equal length along the longitudinal axis of the shaft, not greater than 0.9 inch each. Neither the overlap of the hosel and the hollow shaft end nor the overlap of the pin and the hollow shaft end is greater than 0.9 inch. As desired, the pin may extend from the bottom of the body to the top of the body, only to a point below the top of the body, or or to a point beyond the top of the body. The pin may project further towards the shaft grip end along the longitudinal axis of the shaft than the hosel, or the hosel may project further towards the shaft grip end along the longitudinal axis of the shaft than the pin. The pin and the hosel may be of equal length along the longitudinal axis of the shaft, the pin may be of greater length than the hosel, or the hosel may be of greater length than the pin.

Preferably the annulus is circular, the first bond line is disposed intermediate the inner diameter of the hollow shaft and the outer diameter of the pin, and the second bond line is disposed intermediate the outer diameter of the hollow shaft end and the inner diameter of the hosel.

Typically the pin is a separate and distinct member from the remainder of the golf head and in fixed relative disposition to the remainder of the golf head. The cross sectional area of the pin at the end thereof within the hollow shaft end is less than the cross sectional area of the pin at the other end thereof. One or more guidelines are disposed on the outer surface of the pin for facilitating optional shortening of the pin, prior to insertion of the hollow shaft end into the annulus, in order to vary the weight of the head.

BRIEF DESCRIPTION OF THE DRAWING

The above brief description, as well as further objects and features of the present invention, will be more fully understood by reference to the following detailed description of the presently preferred, albeit illustrative, embodiments of the present invention when taken in conjunction with the accompanying drawing:

FIG. 1 is a front elevational view of a golf club according to the present invention;

FIG. 2 is a fragmentary front elevational view, partially in cross-section and to an enlarged scale, of the golf club showing the head and hollow shaft end;

FIG. 3 is a top plan view of the head;

DETAILED DESCRIPTION OF THE PREFERRED EMBODIMENTS

Figure 4:
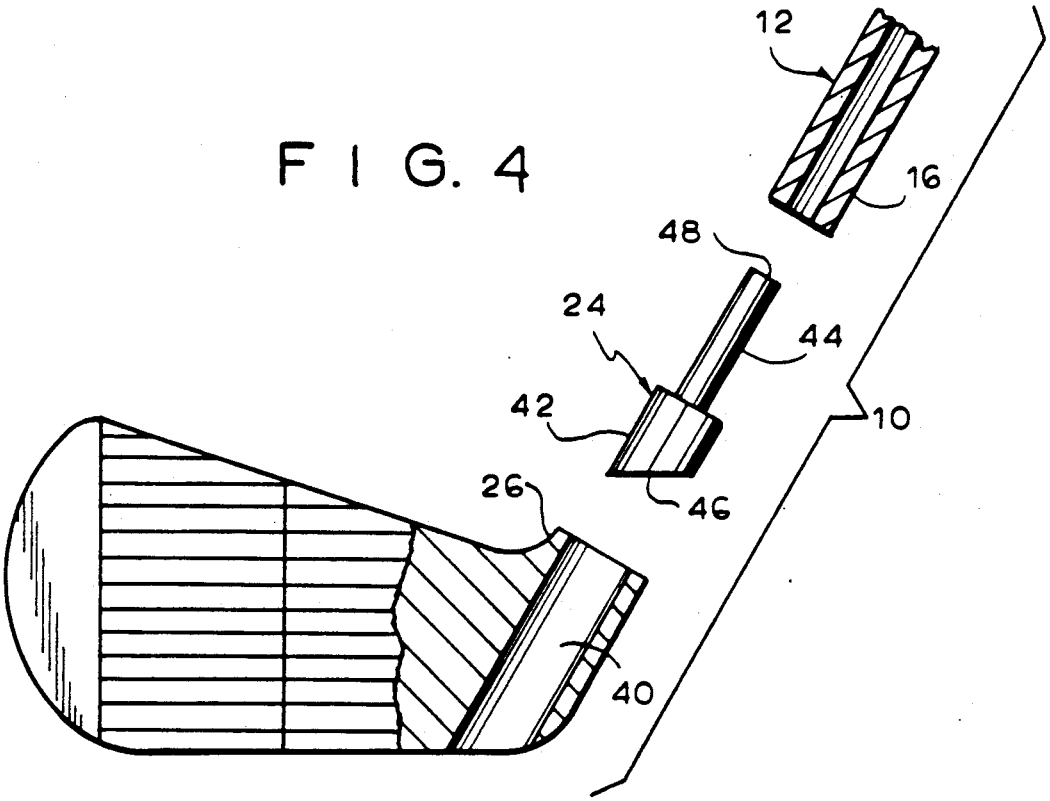
FIG. 4 is a fragmentary exploded view of the head and hollow shaft end.

Referring now to the drawing, and in particular to FIGS. 1-3 thereof, therein illustrated is a golf club, generally designated by the reference numeral 10, according to the present invention. The golf club 10 includes a shaft, generally designated 12, having a grip end 14 and an opposed hollow end 16. The grip end 14 may have a wrapping 15 of leather or like material affording a desirable gripping surface for the user. Typically the entire length of the shaft 12 is hollow, and not just the end 16 adapted to engage the head.

The golf club 10 further includes a club head, generally designated 20, defining a body 22, a male pin 24 and a female hosel 26 disposed about the pin 24. The pin 24 and the hosel 26 together define an annulus 28 therebetween configured and dimensioned to receive therein the hollow shaft end 16. The hosel 26 is abbreviated or short relative to a conventional hosel so that the length of the bond line between the hosel 26 and the hollow shaft end 16 is less than in the conventional golf club construction. In other words, the annulus 28 available for the hosel/shaft end overlap is shallower along the longitudinal axis of the shaft.

The body 22 of the head 20 may be formed of any of the conventional materials used for golf club heads—e.g., investment cast iron, wood, forged metal, graphite, ceramic, etc. The pin 24 is preferably formed of a metal, such as iron or steel, although it may also be formed of other materials.

Adhesive means is disposed both in a first bond line **30*a* occupying the overlap intermediate the inner surface of the hollow shaft end 16 and the outer surface of the pin 24, and in a second bond line 30*b* occupying the overlap intermediate the outer surface of the hollow shaft end 16 and the inner surface of the hosel 26. As illustrated in FIG. 2, the first and second bond lines 30*a*, 30*b* are of about equal length along the longitudinal axis of the shaft 12—that is, they are of about equal length along the axis of the annulus 28. Preferably the first and second bond lines 30*a*, 30*b* are not greater than 0.9 in. each. As the pin 24 and hosel 26 extend about the same length along the axis of the shaft, neither the overlap of the hosel 26 and the hollow shaft end 16 nor the overlap of the pin 24 and the hollow shaft end 16 is greater than 0.9 in. Thus, the individual bond lines 30*a*, 30*b* of the present invention have an axial length (along the longitudinal axis of the shaft) which is about 28% less than the conventional overlap of about 1.25 in. Nonetheless, the security of the attachment of the shaft 12 and head 20 is equal to or better than that provided by the longer bond lines in the conventional constructions because the total effective bond line length of the two bond lines securing the head 20 and shaft 12** together is 1.8 in., even greater than the conventional 1.25 in. length.

For cosmetic purposes, the portion of the shaft 12 projecting immediately upwardly from head 20 is typically covered by a tapered ferrule 34 of metal or plastic, although a wrap of whipping tape may be used for the same purpose.

Referring now to FIG. 4 in particular, the pin 24 is preferably manufactured separately from the head body 22. The body 22 defines a bore 40 extending completely through the head 20 along the shaft axis. The head 20 may be formed with the bore 40 (e.g., by casting), or the bore 40 may be subsequently formed in the head 20 (e.g., by boring). The bore 40 is typically cylindrical and of constant diameter. By way of contrast, the pin 24 includes a lower portion 42 of enlarged diameter and an upper portion 44 of reduced diameter. In other words, the cross sectional area of the pin upper portion 44 (eventually disposed within the hollow shaft end 16) is less than the cross sectional area of the pin lower portion 42. The lower portion 42 has an outer diameter substantially equal to the inner diameter of the bore 40 so as to effect a press or friction fit therebetween, while the upper portion 44 has an outer diameter substantially less than the inner diameter of the bore inner surface 40 so as to define therebetween the annulus 28. The bottom surface 46 of the pin 24 is flush with the bottom portion of the head body 22. When the pin 24 is inserted into the bore 40 through the bottom of the head body 22, as illustrated, means are preferably provided to limit the upward motion of the pin 24 within the bore 40. For example, the pin lower portion 42 may be machined with an outwardly-extending step or a slight taper which will limit the height to which the pin 24 can be inserted into the bore 40 of the head 20. This taper or step is so slight that it is not visible in the drawing. Alternatively, the bottom of the pin 24 may be peened over after insertion of the pin 24 into the bore 40. If desired, alternately the pin 24 may be inserted into the bore 40 through the top of the head 20 and thereafter locked in place.

Additionally, in order to securely lock the pin 24 in a fixed relative spatial disposition to the head body 22, a transverse pin, brad or rivet 47 may be inserted into appropriately provided aligned apertures in the body or hosel of the head 20 and the pin lower portion 42.

The annulus 28 is preferably circular so that the first bond line 30*a* is disposed intermediate the inner diameter of the hollow shaft end 16 and the outer diameter of the pin 24, and the second bond line 30*b* is disposed intermediate the outer diameter of the hollow shaft end 16 and the inner diameter of the hosel 26.

Figure 6:
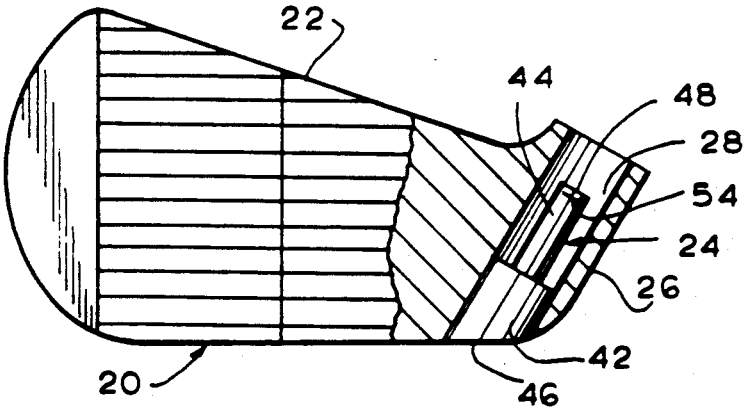
FIG. 6 is a front elevational view of the head after an exemplary grinding of the pin to reduce its length.
Figure 5:
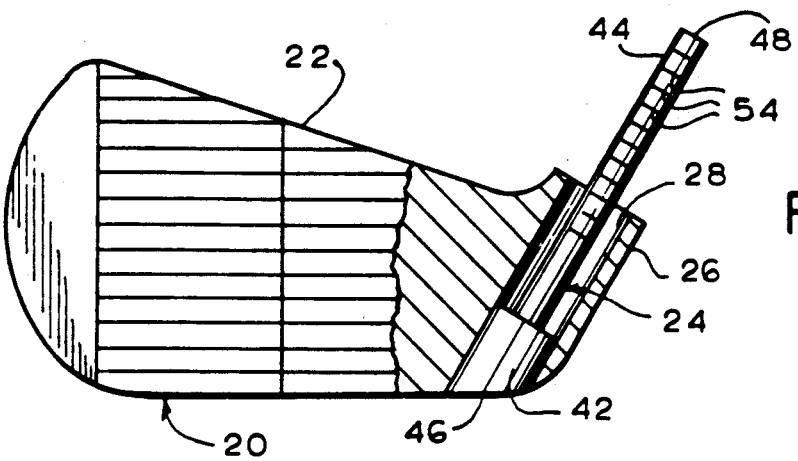
FIG. 5 is a fragmentary front elevational view of the head prior to adjustment of the length of the pin.

As illustrated in FIG. 2, the pin 24 has a length (from the bottom surface 46 thereof to the top surface 48 thereof) which extends from the bottom of the head body 22 to the top of the head body 22 (which is the top of the hosel 26). However, as illustrated in the embodiments of FIGS. 5 and 6, the length of the pin 24 may extend from the bottom of the head body 22 to a point beyond the top of the hosel 26 or to a point below the top of the hosel 26, respectively. In other words, whereas FIG. 2 illustrates the pin 24 and hosel 26 being of equal effective length along the longitudinal axis of the shaft 12, FIG. 5 shows the hosel 26 of greater effective length than the pin 24, and FIG. 6 shows the pin 24 of greater effective length than the hosel 26. "Effective length" refers to the length of the element available for bonding with the shaft hollow end 16. It will be appreciated that where, as in FIG. 6, the effective length of the pin 24 is less than the hosel 26, the combined effects of the bond lines 30*a*, 30*b* must still be sufficient to afford the desired security of attachment between the shaft 12 and the head 20. Similarly, it will be appreciated that where, as shown in FIG. 5, the effective length of the pin 24 is greater than that of the hosel 26, the increased overlap between the shaft 12 and pin 24 decreases the flexibility of the shaft 12 adjacent the head 20, and thereby minimizes the improvement in golf club performance.

Because the pin 24 can be machined from different materials that have different densities, different pins may enable the same heads 20 to be used with different shafts 12, such as graphite or steel shafts, with the heavier pins 24 being used with the lighter shafts 12 and the lighter pins 24 being used for the heavier shafts 12 in order to provide clubs of equivalent weight. Thus, for example, a heavier, more dense pin 24 could be inserted into a head body 22 in order to produce a heavier head 20 for a lightweight graphite shaft 12 than a lighter, less dense pin 24 that would be used in the same head body 22 to produce a lighter head for a heavyweight steel shaft 12.

The pin 24 is preferably made of yellow brass alloy with an upper portion 44 having a length of 1.125 in. (untapered), and the lower portion 42 having a minimum length of 0.35 in. and a maximum length of 0.75 in. (with a taper increasing downwardly from 0.367 in. to 0.374 in.). The upper portion 44 may have a diameter of about 0.270 in. for a heavy pin and a diameter of about 0.130 in. for a light pin.

In order to facilitate personalization of the golf club 10 with a preferred swing weight, the pin 24 is initially manufactured with a length such that the upper surface 48 thereof projects substantially above the hosel 26. Preferably, at least the length of the upper portion 44 of the pin 24 is marked with equally vertically spaced apart circumferential rings 54, the weight of the portion of the pin upper portion 44 intermediate a pair of adjacent rings 54 having a weight of about 2.5 grams or approximately 1 swing weight unit. Prior to insertion of the shaft 12 into the annulus 28, and/or prior to insertion of the pin 24 within the head bore 40, the Pin upper portion 44 may be ground down or cut off as desired to reduce the weight of the pin 24, and thus the weight of the head 20. To this end, the pin 24 will preferably be manufactured a few grams heavier than is normally desired, so that all adjustments may be performed simply by removal of portions of the pin upper portion 44 to achieve the desired head weight.

In the golf industry there is a great deal of opinion concerning "feel." Unfortunately there are no scientific units to measure the subjective term "feel." The impact energy felt by the golfer's hands varies depending on the physical properties of the club head, shaft, grip and joints. Many golfers prefer the soft feel to the hands that to date only the relatively soft forged carbon steel clubs provide (relative to the hard feel of the relatively hard cast stainless steel clubs). It will be appreciated that, in the parlance of the golf world, the reference to a club made of a particular material or process (e.g., "a cast stainless steel club" or "a forged carbon steel club") refers not to all parts of the club, but merely to the particular material of which or the process by which the body of the head is manufactured.

Most golfers have experienced the differences in feel between forged carbon steel clubs and investment cast stainless steel clubs. Most researchers can only attribute this difference in dampening effect to the relative differences in the hardness of the materials used. The common scientific measurement methods used to measure metal hardness are the "Rockwell Scale" and the "Brinell Hardness Scale". For our purposes we will use the Brinell scale. Forged clubs, such as those made of forged carbon steel AISI 1020, have a Brinell hardness of 111, while cast clubs, such as those made of stainless steel 17-4PH, have a Brinell hardness of 363. Thus the cast stainless steel club is significantly harder than the forged carbon steel club. While this suggests that, from the point of view of feel, a club should be made only from forged carbon steel, in fact cast stainless steel clubs have their own unique advantages. The cast stainless steel clubs are easier to manufacture, permit closer weight tolerances, and are more dimensionally exact without expensive machining operations. Accordingly, it is evident that both types of clubs have definite advantages. A theoretically ideal club would have the soft feel of a forged carbon steel club and yet afford the dimensional control, close weight tolerance and easy manufacturing of a cast stainless steel club.

Surprisingly the above-described construction of the golf club provides an unexpected and easy means for altering the feel of the golf club and enabling a hard cast stainless steel club to provide the soft feel of a forged carbon steel club. It has now been found that by careful selection of the material of the pin 24, the feel of a cast stainless steel club, and even a forged carbon steel club, made according to the present invention can be substantially improved (i.e., softened) by use of a pin material which significantly increases the energy dampening aspects of the shaft/head joint. Providing a soft connection in the sensitive tip area of the shaft 12 where it contacts the head 20 dampens the harsh vibrations that would otherwise be transmitted to the shaft and the hands as a result of an impact on the head by the golf ball as the shaft/head joint is the only conduit for energy transfer from the head to the hands.

A preferred material for the pin 24 is yellow brass which has a Brinell hardness of 55, substantially the hardness of either forged carbon steel (about 111) or cast stainless steel (about 363). While the pin is preferably formed of brass, the improved feel can be obtained through the use of any pin which is substantially softer than both the head and the shaft (e.g., a pin formed of aluminum). In other words, where the head is made of cast stainless steel, the pin should be softer than cast stainless steel; where the head is forged carbon steel, the pin should be softer than forged carbon steel. As both cast stainless steel and forged carbon steel have Brinell hardnesses greater than 100, the pin preferably has a Brinell hardness of substantially less than 100.

Since clubs according to the present invention have the pin 24 adjacent only the bottom end and inner diameter of the shaft 12, with the outer diameter of the shaft 12 being adjacent the hosel 26, the pin contact area is only about half of the total shaft/head contact area (and in fact substantially less because the hosel 26 may extend substantially above the height of the pin 24). Nonetheless the estimated 30 to 50% of the total contact area constituted by the pin contributes in a significant and substantial way to the dampening effect of the joint.

The analysis of feel presented above has ignored the effect of the adhesive means along the first and second bond lines 30*a*, 30*b*. As the adhesive means is disposed both on the inner diameter of the shaft 12 (adjacent the pin 24) and on the outer diameter of the shaft 12 (adjacent the hosel 26), clearly the adhesive means used has some impact on the feel, especially the adhesive means used intermediate the pin 24 and the shaft 12. While the effect of the adhesive means is not clearly delineated at this time, a preferred adhesive means is epoxy adhesive, a material which is softer than brass (the preferred material for the pin).

EXAMPLE

In order to determine the effect on feel of using various materials of different hardness for the pin, three clubs were constructed according to the present invention with the only difference being the pin material. The three clubs were No. 5 irons, one using a pin of 316 stainless steel (having a Brinell hardness generally similar to cast stainless steel 17-4PH), one using a pin of yellow brass (an annealed mixture of 65.0 parts Cu and 35.0 parts Zn by weight) having a Brinell hardness of 55, and one using a pin of aluminum alloy 3003 (ASTM B221) having a Brinell hardness of 40 (slightly softer than the pin formed of brass).

Each of the three clubs was used by four golfers. All of the golfers rated the club with the stainless steel pin negatively, as having a significantly hard feel, relative to the clubs having the brass or aluminum pins. A majority of the golfers could not discern a noticable difference in feel between the club having an aluminum pin and the club having a brass pin.

To summarize, the present invention permits softening of the "feel" of a golf club through appropriate selection of the material of the pin, the pin preferably being softer than both the head and the shaft in order to produce a softer feel. Preferably the pin is softer than cast stainless steel, softer than forged carbon steel, and has a Brinell Hardness of substantially less than 100, optimally being formed of brass.

Now that the preferred embodiments of the present invention have been shown and described in detail, various modifications and improvements thereon will become readily apparent to those skilled in the art. Accordingly, the spirit and scope of the present invention is be limited only by the appended claims, and not by the foregoing disclosure.

We claim:

1. A golf club comprising:

(A) a club shaft having a grip end and an opposed hollow end;

(B) a club head having a body, a male pin and a female hosel disposed about said pin, said pin and said hosel together defining an annulus therebetween configured and dimensioned to receive therein said hollow shaft end; and (C) adhesive means disposed both in a first bond line intermediate the inner surface of said hollow shaft end and the outer surface of said pin and in a second bond line intermediate the outer surface of said hollow shaft end and the inner surface of said hosel.

2. The golf club of claim 1 wherein said first and second bond lines are of about equal length along the longitudinal axis of said shaft.

3. The golf club of claim 1 wherein said first and second bond liens are not greater than 0.9 inch each.

4. The golf club of claim 1 wherein the overlap of said hosel and said hollow shaft end is not greater than 0.9 inch.

5. The golf club of claim 1 wherein the overlap of said pin and said hollow shaft end is not greater than 0.9 inch.

6. The golf club of claim 1 wherein said pin extends to the top of said hosel.

7. The golf club of claim 6 wherein said pin extends from the bottom of said body to the top of said hosel.

8. The golf club of claim 1 wherein said pin extends only to a point below the top of said hosel.

9. The golf club of claim 8 wherein said pin extends from the bottom of said body only to a point below the top of said hosel.

10. The golf club of claim 1 wherein said pin extends to a point beyond the top of said hosel.

11. The golf club of claim 10 wherein said pin extends from the bottom of said body to a point beyond the top of said hosel.

12. The golf club of claim 1 wherein said pin projects further towards said shaft grip end along the longitudinal axis of said shaft than said hosel.

13. The golf club of claim 1 wherein said hosel projects further towards said shaft grip end along the longitudinal axis of said shaft than said pin.

14. The golf club of claim 1 wherein said pin and said hosel are of equal effective length along the longitudinal axis of said shaft.

15. The golf club of claim 1 wherein said pin is of greater effective length along the longitudinal axis of said shaft than said hosel.

16. The golf club of claim 1 wherein said hosel is of greater effective length along the longitudinal axis of said shaft than said pin.

17. The golf club of claim 1 wherein said annulus is circular, said first bond line is disposed intermediate the inner diameter of said hollow shaft and the outer diameter of said pin, and said second bond lien is disposed intermediate the outer diameter of said hollow shaft end and the inner diameter of said hosel.

18. The golf club of claim 1 wherein said pin is a separate and distinct member from the remainder of said golf head and in fixed relative disposition to the remainder of said golf head.

19. The golf club of claim 1 wherein the cross sectional area of said pin at the end thereof within said hollow shaft end is less than the cross sectional area of said pin at the other end thereof.

20. The golf club of claim 1 additionally including a one or more guidelines disposed on the outer surface of said pin for facilitating optional shortening of said pin, prior to insertion of said hollow shaft end into said annulus, in order to vary the weight of said head.

21. A golf club comprising:

(A) a club shaft having a grip end and an opposed hollow end;

(B) a club head having a body, a male pin and a female hosel disposed about said pin, said pin and said hosel together defining an annulus therebetween configured and dimensioned to receive therein said hollow shaft end, the overlap of said hosel and said hollow shaft end being not greater than 0.9 inch, said pin being a separate and distinct member from the remainder of said head, extending from the bottom of said body towards the top of said hosel in fixed relative disposition to the remainder of said head, and having a cross sectional area at the end thereof within said hollow shaft end less than the cross sectional area at the other end thereof; and (C) adhesive means disposed both in a first bond line intermediate the inner surface of said hollow shaft end and the outer surface of said pin and in a second bond line intermediate the outer surface of said hollow shaft end and the inner surface of said hosel, said first and second bond lines being of about equal length along the longitudinal axis of said shaft and not greater than 0.9 inch each.

22. In a gold club including (A) a head having a sole, a through bore opening into said sole, and a hosel concentric with said through bore, and (B) a club shaft having a hollow distal end for connection to said club head;

the improvement comprising (C) a pin mounted in said through bore and cooperating with said hosel to define a shaft-receiving annulus, said hosel, pin and shaft distal end being relatively configured and dimensioned such that said pin fits into said shaft distal end and said shaft distal end fits into said hosel, and (D) means for securing said shaft distal end in said shaft-receiving annulus.

23. A golf club comprising:

(A) a club shaft having a grip end and an opposed hollow shaft end;

(B) a club head having a body, a male pin attached to said body and a female hosel formed integrally with said body and disposed about said pin, said pin and said hosel together defining an annulus therebetween configured and dimensioned to receive therein said shaft end, said shaft end being received in said annulus; and (C) means in said annulus for securing together said shaft end and said club head.

24. In a golf club including (A) a club head having a sole, a bore and a hosel concentric with said bore, and (B) a club shaft having a hollow distal end for connection to said club head;

the improvement comprising (C) a pin mounted in said bore and secured to said club head and cooperating with said hosel to define a shaft-receiving annulus, said hosel, pin and shaft distal end being relatively configured and dimensioned such that said shaft distal end fits into said shaft-receiving annulus; and (D) means for securing said shaft distal end in said shaft-receiving annulus.

25. The golf club of claim 24 wherein said hosel, pin and shaft end are relatively configured and dimensioned such that said pin fits into said shaft distal end when said shaft distal end is secured in said hosel.

26. The golf club of claim 25 wherein said securing means is adhesive means.

27. In a golf club including (A) a club head having a sole, a bore opening into said sole, and a hosel concentric with said through bore;

(B) a club shaft having a hollow distal end for connection to said club head;

(C) a pin mounted in said through bore and secured to said club head and cooperating with said hosel to define a shaft-receiving annulus, said hosel, pin and shaft distal end being relatively configured and dimensioned such that said shaft distal end fits into said shaft-receiving annulus; and (D) means for securing said shaft distal end in said shaft-receiving annulus;

the improvement comprising:

said pin being softer than both said head and said shaft.

28. The golf club of claim 27 wherein said pin is brass.

29. The golf club of claim 27 wherein said head is cast stainless steel, and said pin is softer than cast stainless steel.

30. The golf club of claim 27 wherein said head is forged carbon steel, and said pin is softer than forged carbon steel.

31. The golf club of claim 27 wherein said head and said shaft have a Brinnel Hardness greater than 100, and said pin has a Brinell Hardness of substantially less than 100.

32. The golf club of claim 27 wherein the interior of said shaft distal end is in physical contact only with said pin and said securing means.

33. The golf club of claim 27 wherein said pin is a male pin, said hosel is a female hosel disposed about said pin, and said pin and said hosel together define said shaft-receiving annulus therebetween, said shaft-receiving annulus is configured and dimensioned to receive therein said shaft distal end, and said securing means comprises adhesive means.

34. The golf club of claim 33 wherein said adhesive means is softer than said pin.

35. The golf club of claim 33 wherein said adhesive means is disposed both in a first bond line intermediate the inner surface of said shaft distal end and the outer surface of said pin and in a second bond line intermediate the outer surface of said shaft distal end and the inner surface of said hosel.

36. The golf club of claim 35 wherein said adhesive means is softer than said pin.

37. The golf club of claim 33 wherein said adhesive means is epoxy.

38. The golf club of claim 37 wherein said pin is brass.

39. The golf club of claim 38 wherein said head is cast stainless steel.

40. A golf club comprising:

(A) a cast stainless steel club head having a sole, a through bore opening into said sole, and a female hosel concentric with said through bore;

(B) a club shaft having a hollow distal end for connection to said club head;

(C) a male pin of brass softer than both said head and said shaft mounted in said through bore and secured to said club head and cooperating with said hosel to define therebetween a shaft-receiving annulus, said hosel, pin and shaft distal end being relatively configured and dimensioned such that said pin fits into said shaft distal end and said shaft distal end fits into said hosel; and (D) adhesive means for securing said shaft distal end in said shaft-receiving annulus, said adhesive means being disposed both in a first bond line intermediate the inner surface of said shaft distal end and the outer surface of said pin and in a second bond line intermediate the outer surface of said shaft distal end and the inner surface of said hosel.

* * * * *

UNITED STATES PATENT AND TRADEMARK OFFICE

CERTIFICATE OF CORRECTION

PATENT NO. : 5,181,720

DATED : January 26, 1993

INVENTOR(S) : John T. Stites and Jerome M. Austry

It is certified that error appears in the above-identified patent and that said Letters Patent is hereby corrected as shown below:

Column 7, line 21, after "substantially" insert --lower than--.
Claim 3, column 8, line 44, change "liens" to --lines--.
Claim 17, column 9, line 16, change "lien" to --line--.
Claim 20, column 9, line 27, delete "a".
Claim 22, column 9, line 58, change "gold" to --golf--.
Claim 31, column 10, line 61, change "Brinnel" to --Brinell--.

Signed and Sealed this

Twenty-fifth Day of January, 1994

*Attest:*

Bruce Lehman

BRUCE LEHMAN

*Attesting Officer*

*Commissioner of Patents and Trademarks*